United States Patent [19]

Igarashi et al.

[11] Patent Number: 4,855,278

[45] Date of Patent: Aug. 8, 1989

[54] HEAT-SENSITIVE RECORDING MATERIAL

[75] Inventors: Akira Igarashi; Masato Satomura; Ken Iwakura, all of Shizuoka, Japan

[73] Assignee: Fuji Photo Film Co., Ltd., Kanagawa, Japan

[21] Appl. No.: 60,556

[22] Filed: Jun. 11, 1987

[30] Foreign Application Priority Data

Jun. 11, 1986 [JP] Japan ..... 61-135847

[51] Int. Cl.[4] ..... B41M 5/18

[52] U.S. Cl. ..... 503/208; 427/151; 428/211; 428/342; 428/537.5; 428/913; 503/200; 503/209; 503/221; 503/225

[58] Field of Search ..... 427/150–152; 503/208, 209, 217, 221, 225, 200; 428/211, 342, 537.5, 913

[56] References Cited

U.S. PATENT DOCUMENTS

| | | | |
|---|---|---|---|
| 4,255,491 | 3/1981 | Igarashi | 428/913 |
| 4,531,140 | 7/1985 | Suzuki et al. | 503/208 |
| 4,628,335 | 12/1986 | Igarashi et al. | 503/221 |

FOREIGN PATENT DOCUMENTS

| | | | |
|---|---|---|---|
| 0115292 | 9/1981 | Japan | 503/200 |
| 1125879 | 6/1986 | Japan | 503/200 |

*Primary Examiner*—Bruce H. Hess
*Attorney, Agent, or Firm*—Sughrue, Mion, Zinn, Macpeak & Seas

[57] ABSTRACT

A heat-sensitive recording material is disclosed. The material comprises a neutral paper support having provided on at least one surface thereof a heat-sensitive color forming layer containing a fluoran derivative having an arylamino group at the 2-position and an amine residual group at the 6-position, an electron accepting compound, a hindered phenol derivative and a heat-fusible compound represented by formula (I):

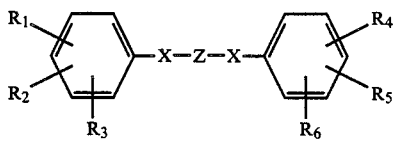

(I)

wherein $R_1$, $R_2$, $R_3$, $R_4$, $R_5$ and $R_6$, which may be the same or different, each represents a hydrogen atom, an alkyl group, an alkoxy group, a phenyl group or a halogen atom, X represents an oxygen atom or a sulfur atom, and Z represents a divalent group.

11 Claims, No Drawings

HEAT-SENSITIVE RECORDING MATERIAL

FIELD OF THE INVENTION

The present invention relates to a heat-sensitive recording material, and more particularly, to a heat-sensitive recording material employing a color forming reaction between a colorless or slightly colored electron donating dye precursor and an electron accepting compound.

BACKGROUND OF THE INVENTION

A so-called two-component type heat-sensitive recording material using a color forming reaction between a colorless or slightly colored electron donating dye precursor and an electron accepting compound is disclosed, for example, in Japanese Patent Publication Nos. 14039/70 (corresponding to U.S. Pat. No. 3,539,375) and 4160/68. This type of two-component color forming heat-sensitive recording material is prepared by dispersing a colorless or slightly colored electron donating dye precursor and an electron accepting compount into a fine particle state, mixing a binder and the like therewith so that the electron donating dye precursor and the electron accepting compound are separated, and coating the mixture on a support. Upon heating, these heat-sensitive compounds melt and contact each other, resulting in a color forming reaction whereby recording takes place.

Such two component type color forming heat-sensitive recording materials are advantageous in that: (1) primary coloration takes place and therefore color development is unnecessary; (2) paper quality is similar to that of used for conventional types of recording; (3) handling is easy; (4) color density of the resulting images is high; and (5) upon color formation, various hues can be obtained. Accordingly, this type of recording material is very valuable. Therefore, this type of two-component color forming heat-sensitive recording material has become widely used recently, particularly in the fields of facsimile transmissions, recorders, and printers. With such increasingly wide usage in the field of facsimile transmissions, the recording rate has also increased significantly in recent years. Thus, in view of this tendency to increase facsimile recording rates, a strong demanded has arisen for heat-sensitive recording materials which have a short pulse, that is, the ability to undergo color formation with low energy input. In other words, improvement of heat reactivity of the recording materials has long been desired.

It has been suggested as one approach to satisfying this demand that the melting point of the electron accepting compound be raised from 60° C. to 100° C. However, it is difficult to adjust the melting point of phenol compounds, which are the most widely used of the known electron accepting compounds; further, such phenol compounds are costly and thus are not practical to use.

Another approach, disclosed in Japanese Patent Publication Nos. 17748/74 and 39567/76, is to use organic acids and phenol compounds in combination, or, alternatively, to use polyvalent metal salts of compounds having alcohol hydroxy groups as an electron accepting compound. Still another approach, disclosed in U.S. Pat. No. 3,859,112 and 3,936,309 is to employ a copolymer of hydroxyethyl cellulose and maleic anhydride as an electron accepting compound.

It is also disclosed in Japanese Patent Publication No. 27599/76 and Japanese Patent Application (OPI) No. 19231/73 (the term "OPI" as used herein means an "unexamined published application") that waxes may be added to the recording material to improve heat reactivity.

It is further known that a nitrogen-containing organic compound, such as thioacetoanilide, phthalonitrile, acetoamide, di-β-naphthyl-p-phenylenediamine, fatty acid amide, acetoacetic anilide, diphenylamine, benzamide, or carbazole, a heat fusible substance such as 2,3-di-m-tolylbutane, 4,4'-dimethyl biphenyl, or a carboxylic acid ester such as dimethyl isophthalate, diphenyl phthalate, dimethyl terephthalate, may be used as a sensitizer, as described in U.S. Pat. Nos. 3,895,173 and 4,236,732, Japanese Patent Application (OPI) Nos. 115554/74, 149353/75, 106746/77, 5636/78, 11036/78, and 72996/81.

However, heat-sensitive recording materials which incorporate the above-described compounds are not completely satisfactory. Specifically, such heat-sensitive recording materials have defects in that density and heat responsiveness are not satisfactory. Also, fog formation occurs under high temperature and high humidity conditions, and fine powders appear on the surface of the heat-sensitive color forming layer with the passage of time, thus causing the color formed images to fade.

SUMMARY OF THE INVENTION

Accordingly, an object of the present invention is to provide a heat-sensitive recording material which results in recorded images having sufficient color formation density, and which are capable of reducing the occurrence of fog formation under high temperature and high humidity conditions, as well as reducing the tendency of color formed images to fade with the passage of time.

The above and other objects of the present invention can be attained by a heat-sensitive recording material comprising a neutral paper support having provided on at least one surface thereof a heat-sensitive color forming layer containing a fluoran derivative having an arylamino group at the 2-position and an amine residual group at the 6-position, an electron accepting compound, a hindered phenol derivative and a heat-fusible compound represented by formula (I):

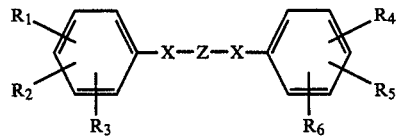

(I)

wherein $R_1$, $R_2$, $R_3$, $R_4$, $R_5$ and $R_6$, which may be the same or different, each represents a hydrogen atom, an alkyl group, an alkoxy group, a phenyl group or a halogen atom, X represents an oxygen atom or a sulfur atom, and Z represents a divalent group.

DETAILED DESCRIPTION OF THE INVENTION

The neutral paper support used in the present invention has a pH of about 6.5 or higher, and more particularly from 6.5 to 9.0, after cold extraction as defined in JIS P8133, and a detailed description thereof is disclosed in Japanese Patent Application (OPI) No. 98915/73.

The fluoran derivative is employed in the present invention as the electron donating dye precursor which undergoes a color forming reaction with the electron accepting compound upon application of heat. The arylamino group at 2-position of the fluoran derivative used in the present invention may have a substituent, and the preferred examples thereof are an alkyl group, an alkoxy grup, and a halogen atom.

The amine residual group at the 6-position of the fluoran derivative is preferably a secondary amine residual group.

The 3-position of the fluoran derivative is preferably substituted by a hydrogen atom, an alkyl group, an alkoxy group or a halogen atom.

In accordance with the above fluoran derivatives having an anilino group having from 6 to 10 carbon atoms at the 2-position, a secondary amine residual group having 12 or less total carbon atoms at the 6-position, and a hydrogen atom, an alkyl group having from 1 to 8 carbon atoms, an alkoxy groups having from 1 to 6 carbon atoms or a halogen atom at the 3-position are especially preferred for use in the present invention.

Specific examples thereof include 2-anilino-3-methyl-6-diethylaminofluoran, 2-anilino-3-methyl-6-N-i-pentyl-N-ethylaminofluoran, 2-anilino-3-methyl-6-N-i-butyl-N-ethylaminofluoran, 2-anilino-3-methyl-6-N-cyclohexyl-N-methylaminofluoran, 2-anilino-3-methyl-6-dibutylaminofluoran, 2-p-chloroanilino-3-methyl-6-diethylaminofluoran, 2-anilino-3-chloro-6-diethylaminofluoran, 2-anilino-3-chloro-6-dibutylaminofluoran, 2-anilini-3-chloro-6-N-i-pentyl-N-ethylaminofluoran, 2-anilino-3-methoxy-6-dibutylaminofluoran, 2-(2,4-dimethylanilino)-6-dibutylaminofluoran, and 2-p-n-butylanilino-3-methyl-6-diethylaminofluoran.

These fluoran derivatives may be used alone or in combination. To satisfy the objectives of the present invention, it is preferred that two or more fluoran derivatives be used in combination. Particularly, it is most preferred that two or more fluoran derivatives exhibiting nearly the same colored hue are used in an amount of about 10 wt % or more, based on the total amount of the fluoran derivatives, respectively.

The electron accepting compounds suitable for use in the present invention include the compounds having phenolic hydroxy groups as disclosed in Japanese Patent Publication Nos. 14039/70 (corresponding to U.S. Pat. No. 3,539,375) and 29830/76.

Specific examples thereof include methyl-4-hydroxybenzoate, benzyl-4-hydroxybenzoate, ethyl-4-hydroxybenzoate, 2,2'-dihydroxybiphenyl, 2,2-bis(4-hydroxyphenyl)propane (bisphenol A), 4,4'-isopropyridenebis(2-methylphenol), 1,1-bis(3-chloro-4-hydroxyphenyl)cyclohexane, 1,1-bis(3-chloro-4-hydroxyphenyl)-2-ethylbutane, 4,4'-secondary-isobutylydenedipehnyl, 1,1-bis(4-hydroxyphenyl)cyclohexane, 1,4-bis(p-hydroxycumyl)benzene, 1,3-bis(p-hydroxycumyl)benzene, bis(4-hydroxyphenylsulfone), 4-hydroxy-2',4'-dimethylphenyl-sulfone, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, zinc 3,5-di-t-octyl salicylate, zinc 4-tetradecyl salicylate, and 4-β-p-methoxyphenoxy salicylic acid.

With respect to the groups represented by $R_1$, $R_2$, $R_3$, $R_4$, $R_5$ and $R_6$ in the heat fusible compounds represented by formula (I) used in the present invention, a hydrogen atom, an alkyl group having from 1 to 8 carbon atoms, an alkoxy group having from 1 to 8 carbon atoms, a phenyl group and a halogen atom are preferred. Further, an alkyl group having from 1 to 4 carbon atoms, an alkoxy group having from 1 to 4 carbon atoms, a phenyl group, a chlorine atom and a fluorine atom are particularly preferred.

As to the divalent groups represented by Z, an alkylene group which may contain an oxygen atom, a sulfur atom, a hydroxy group or a chlorine atom and has from 1 to 10 carbon atoms is preferred, and an alkylene group and an oxaalkylene group having from 2 to 5 carbon atoms is particularly preferred. Specific examples thereof include 1-phenoxy-2-p-tolyloxyethane, bis-(2-β-naphthyloxyethyl)ether, 1,2-bis{2-(p-tolyloxy)ethoxy}ethane, bis(2-p-tolyloxyethyl) ether, bis-(β-3,5-dimethylphenoxyethyl)ether, 1,2-bisphenoxyethane, 1,2-bis-p-tolyloxyethane, 1,2-bis-p-chlorophenoxyethane, 1,2-bis-p-methoxyphenoxyethane, 1,3-bis-p-tolyloxypropane, 1,3-bis-p-chlorophenoxypropane, 1,4-bisphenoxybutane, 1,4-bis-p-tolyloxybutane, 1,4-bis-p-chlorophenoxybutane, 1,4-bis-α-naphthyloxybutane, 1,6-bisphenoxyhexane, 1,2-bis{2-(3,5-dimethylphenoxy)ethoxy}ethane, 1-phenoxy-2-p-chlorophenyloxyethane, 1,2-bis{2-β-naphthyloxyethoxy}ethane, bis{2-p-tolyloxyethoxy}methane, bis{2-(2,4,6-trimethylphenoxy)ethoxy}methane, 1-phenoxy-2-β-naphthyloxyethane, bis{2-β-naphthyloxyethoxy}methane, bisphenoxymethylsulfide, bis(2-phenoxyethyl)sulfide, 1,3-bisphenoxymethylbenzene, 1,2-bisphenoxymethylbenzene, bisphenoxymethylether, 1-phenoxy-2-p-ethylphenoxyethane, 1,3,5-trisphenoxyethoxybenzene, 1-phenoxy-2-p-tolyloxyethane, 1-phenoxy-2-β-naphthyloxypropane, 1-p-tolyloxy-2-p-chlorophenoxyethane, 1-phenoxy-2-ethylphenoxyethane, 1-phenoxy-2-p-ethylphenoxyethane, 1,2-bis-m-tolyloxyethane, 1-p-tolylthio-2-p-biphenyloxyethane, 1-p-tolylthio-2-p-ethoxyphenoxyethane, 1,2-bis-p-methoxyphenylthioethane, 1,2-bis-p-chlorophenylthioethane, and 1,4-bis-p-methoxyphenylthiobutane. In these compounds, those having a melting point of from 70° to 150° C. are particularly preferred.

The hindered phenol derivatives used in the present invention are phenol compounds having at least one alkyl substituent at the 2- or 6-position or a derivative thereof, and phenol compounds having a branched alkyl substituent at the 2- or 6-position and its derivatives are preferred. Hindered phenol derivatives which comprise a plurality of phenol groups, particularly having from 2 to 3 phenol groups, are also preferred. Specific examples thereof include bis-[3,3-bis-(4'-hydroxy-3'-tert-butylphenyl)-butanoic acid]glycol ester, bis-[3,3-bis-(4'-hydroxy-3',4'-ditertbutylphenyl)-butanoic acid]-glycol ester, bis-[3,3-bis-(2'-methyl-4'-hydroxy-5'-tert-butylphenyl)-butanoic acid]glycol ester, 1,1,3-tris(2-methyl-4-hydroxy-5-tert-butylphenyl)-butane, 4,4'-thiobis(3-methyl-6-tert-butylphenol), 4,4'-thiobis(2-methyl-6-tert-butylphenol), 2,2'-thiobis(4-methyl-6-tert-butylphenol), 2,2'-methylenebis(4-methyl-6-tertbutylphenol), 2,2'-methylenebis(4-ethyl-6-tert-butylphenol), 4,4'-butylydenebis(3-methyl-6-tert-butylphenol), 4,4'-methylenebis(2,6-ditert-butylphenol), 2-tert-butyl-4-tert-buthoxyphenol, 2,2-dimethyl-4-isopropyl-7-tert-butyl-6-chromanol, 2,2-dimethyl-6-t-butyl-5-benzofuranol, and 4-[{4,6-bis(tertbutylthio)-s-triazine-2-yl}amino]-2,6-di-tert-butylphenol.

In the present invention, remarkably striking sensitizing and colored image fading-preventing effects can be obtained by incorporating the combination of a fluoran derivative, an electron accepting compound, a heat fusible compound and a hindered phenol derivative as described above into the color forming layer.

By the above-described combination of compounds in the color forming layer, a heat-sensitive recording material having excellent heat responsive properties can be obtained. However, when an acid sized conventional paper is used as a support, for formation easily occurs, and the effects of the present invention cannot be attained. It was thus discovered that a practically useful heat-sensitive recording material having excellent heat responsive properties cannot be obtained unless a heat-sensitive color forming layer is provided on a nearly neutral paper support using the above-described combination of compounds in the forming layer in accordance with the present invention.

A method for preparing a heat-sensitive recording material of the present invention is illustrated hereinafter.

The fluoran derivative and the electron accepting compound of the present invention are respectively dispersed with a water-soluble polymer by a ball mill, a sand mill, an attritor, a three roller mill, a pebble mill or the like to prepare particles having a particle diameter of several microns.

The heat-fusible compound represented by formula (I) and the hindered phenol derivative are dispersed in the same manner as above. These compounds can be dispersed alone, or they can be mixed with a fluoran type dye precursor or an electron accepting compound before dispersion, and then can be dispersed with a water-soluble polymer thereafter. In this latter case, it is preferred that the heat-fusible compound is mixed with an electron accepting compound before dispersion. Regarding the ratio of the compound to be dispersed, the water-soluble polymer and water as the dispersion medium, the ratio of the water-soluble polymer is adjusted to from 1 to 30 wt %, preferably from 2 to 20 wt % based on the compound to be dispersed and the concentration of the water-soluble polymer upon dispersing is further adjusted to from 1 to 30 wt %, preferably from 2 to 15 wt % based on the compound to be dispersed.

With respect to the dispersion, the mixing ratio of the electron accepting compound to the fluoran derivative is from 50 to 300 wt %, preferably from 100 to 300 wt %, while that of the heat fusible compound represented by formula (I) to the electron accepting compound is from 20 to 300 wt %, preferably from 50 to 150 wt %, and that of the hindered phenol derivative to the electron accepting compound is from 20 to 300 wt %, preferably from 50 to 150 wt %.

The following additives can be added into the mixture of the dispersion in order to meet various requirements described below for a heat-sensitive recording paper.

Examples of such additives include oil absorbing substances such as an inorganic pigment, are dispersed in a binder to prevent head stain upon recording; furthermore, fatty acids, metal soaps, waxes and the like are added thereto to increase the material's ability to separate from a thermal head.

Specific examples of such pigments include kaolin, calcined kaolin, talc, agalmatolite, diatom earth, calcium carbonate, aluminum hydroxide, magnesium hydroxide, magnesium carbonate, titanium oxide, barium carbonate, silica, urea-formalin filler, cellulose filler and the like.

Regarding the inorganic pigments, it is preferred that at least two kinds of white pigments having a particle size of 15 μm or less are mixed in amount such that one of the pigment is used in a ratio of 5 wt % or more.

Suitable waxes include paraffin wax, carnauba wax, microcrystalline wax, polyethylene wax and higher fatty acid esters and the like.

Suitable metal soaps include higher fatty acid polyvalent metal salts such as zinc stearate, aluminum stearate, calcium stearate, zinc oleate and the like.

The binders used upon dispersion include polyvinyl alcohol, hydroxyethyl cellulose, hydroxypropyl cellulose, a copolymer of ethylene and maleic anhydride, a copolymer of styrene and maleic anhydride, a copolymer of isobutylene and maleic anhydride, polyacrylic acid, polyacrylic acid amide, starch derivatives, casein, gelatin, carboxymethyl cellulose, styrene butadiene rubber latex, methyl cellulose and the like.

Upon dispersion, the dispersibility is, in many cases, increased when a slight amount of surface active agents or water soluble oligomer is added. The additive amount thereof is from 0.4 to 2.0 g/m$^2$, preferably from 0.5 to 1.5 g/m$^2$, respectively.

Agents which provide a water-resistant property (e.g., gelling agent or cross-linking agents) or emulsions of a hydrophobic polymer such as styrene butadiene rubber latex, acrylonitrile butadiene rubber latex, methyl acrylate butadiene rubber latex or vinyl acetate emulsion, or electroconductive agents, fluorescent whitening agents, defoaming agents and the like can be added to the binder in order to impart water-resistance to the binder.

The thus-prepared coating solution is coated on a neutral paper in accordance with the present invention. Regarding the coating amounts, the fluoran derivatives of the present invention are employed in an amount of from about 0.2 to about 0.8 g/m$^2$, preferably from 0.3 to 0.6 g/m$^2$. The lower limit thereof can be readily determined by one of ordinary skill in the art based on the density of prints desired, and the upper limit within the above range is determined based on economical reasons.

The present invention is illustrated in more detail by the following Examples and Comparative Examples, but the present invention should not be construed as being limited in any manner thereof. Unless otherwise indicated, all parts, percents, ratios and the like are by weight.

EXAMPLES 1 TO 14

The fluoran derivatives as shown in Table 1 were dispersed in a ball mill for one day and one night. That is, 20 g of the fluoran derivative and 100 g of a 5% aqueous solution of polyvinyl alcohol ("PVA-105", a trade name, manufactured by Kuraray Co., LTD.) were added and dispersed into 300 ml ball mill. The volume average particle diameter of the dispersion was from 1.2 to 2.2 μm.

The electron accepting compounds and the heat-fusible compounds as shown in Table 1 were mixed in a mixing ratio of 1:1 and were dispersed in a ball mill for one day and one night having the same solid content as that of the ball mill dispersion containing fluoran derivative. The volume average particle diameter of the dispersion was from 1.5 to 2.5 μm.

Further, the hindered phenol derivatives as shown in Table 1 were dispersed in a ball mill for one day and one night having the same solid content as that of ball mill dispersion containing the fluoran derivative. The volume average particle diameter of the dispersion was from 1.5 to 3.0 μm.

100 g of calcium carbonate ("Brilliant 15", a trade name, manufactured by Shiraishi Industry Co., Ltd.) were dispersed with 1 g of a polyacrylic acid having a concentration of 45%, and a dispersion having a volume average particle diameter of 0.7 μm was obtained.

Each solution containing a fluoran derivative, a phenol compound, a heat-fusible compound, a hindered phenol derivative and calcium carbonate were mixed in a ratio of 3:10:10:10:20, and a zinc stearate dispersion was added in the same amount by solid content as that of fluoran derivative. The resulting composition was coated on a neutral paper (pH of 7.8 after cold extraction) so that the fluoran derivative was coated in an amount of 0.5 g/m$^2$ and was then subjected to calendering treatment to obtain a heat-sensitive recording material.

Evaluation of the resulting coated papers was made in the following manner.

(i) Print density:

Printing was conducted using a printing energy of 35 mJ/mm$^2$ with a printer manufactured by Kyocera Co., Ltd., and the density was measured by a Macbeth densitometer. The print density was such that printing was conducted with 8 dot/mm × 6 dot/mm, and with a pulse width of 1 ms.

(ii) Fog formation:

Fog formation on the coated paper was measured using a Macbeth densitometer, and the coated paper was then allowed to stand under conditions of 50° C. and 90% RH (relative humidity) for 24 hours and the fog generated on the coated paper under these conditions was also measured using the same densitometer.

(iii) Image storage stability:

Two coated paper, printed in accordance with (i) above were respectively allowed to stand under conditions (A) of 50° C. and 90% RH for 24 hours and under conditions (B) of room temperature and from 40 to 60% RH for 8 months, and then the print density was measured.

COMPARATIVE EXAMPLE 1 TO 6

The same procedure as in Examples 1 to 14 was repeated using the materials as shown in Table 1, except that rosin sized paper having a pH of 4.3 after cold extraction was used as a support in Comparative Examples 2, 4, and 6.

The results thereof are shown in Table 2, and the effects of the present invention are clearly apparent therefrom.

TABLE 1

| Example No. | Flouran Derivatives | Electron Accepting Compounds | Heat Fusible Compounds | Hindered Phenol Derivatives |
|---|---|---|---|---|
| 1 | 2-anilino-3-chloro-6-diethylaminofluoran | 2,2-bis(4-hydroxyphenyl)-propane | 1-phenoxy-2-p-ethyl-phenoxyethane | 1,1-bis(2-methyl-4-hydroxy-5-t-butylphenyl)butane |
| 2 | " | " | 1,2-bis(m-tolyloxy)-ethane | " |
| 3 | " | " | 1,4-bisphenoxybutane | " |
| 4 | 2-anilino-3-methyl-6-N—isoamyl-N—ethylamino-fluoran | " | 1-phenoxy-2-p-ethyl-phenoxyethane | " |
| 5 | " | " | 1,2-bis(m-tolyoxy)-ethane | " |
| 6 | " | 1,1-bis(4-hydroxyphenyl)-cyclohexane | " | 1,1,3-tris(3-methyl-4-hydroxy-5-t-butylphenyl)butane |
| 7 | " | " | 1,2-bis(p-methoxy-phenylthio)ethane | 1,1-bis(2-methyl-4-hydroxy-5-t-butylphenyl)butane |
| 8 | mixture of 2-anilino-3-chloro-6-diethylamino-fluoran and 2-anilino-3-methyl-6-N—isoamyl-N—ethylaminofluoran in equal amounts | 2,2-bis(4-hydroxyphenyl)-propane | 1-phenoxy-2-p-ethyl phenoxyethane | " |
| 9 | " | " | " | " |
| 10 | " | " | " | bis(2-methyl-4-hydroxy-5-t-butylphenyl)sulfide |
| 11 | " | " | 1-phenoxy-2-p-ethyl phenoxyethane | bis(2-hydroxy-3-t-butyl-5-methylphenyl)methane |
| 12 | mixture of 2-anilino-3-chloro-6-diethylamino-fluoran and 2-anilino-3-methyl-6-N—cyclohexy-N—methylaminofluoran in equal amounts | 2,2-bis(4-hydroxyphenyl)-propane | 1,2-bis(p-methoxy-phenylthio)ethane | bis(2-hydroxy-3-t-butyl-5-methylphenyl)methane |
| 13 | " | 1,4-bis(4-hydroxycumyl)-benzene | 1-phenoxy-2-p-ethyl-phenoxyethane | 1,1-bis(2-methyl-4-hydroxy-5-t-butylphenyl)butane |
| 14 | " | " | 1,2-bis(m-tolyloxy)-ethane | " |
| Comparative Example | | | | |
| 1 | 2-anilino-3-chloro-6-diethylaminofluoran | 2,2-bis(4-hydroxyphenyl) propane | " | — |
| 2 | " | " | " | 1,1-bis(2-methyl-4-hydroxy-5-t-butylphenyl)butane |
| 3 | 2-anilino-3-methyl-6-N—isoacylamino-N—ethyl-aminofluoran | " | 1-phenoxy-2-p-ethyl phenoxyethane | — |
| 4 | " | " | " | 1,1-bis(2-methyl-4-hydroxy-5- |

TABLE 1-continued

| Example No. | Flouran Derivatives | Electron Accepting Compounds | Heat Fusible Compounds | Hindered Phenol Derivatives |
|---|---|---|---|---|
| | | | | t-butylphenyl)butane |
| 5 | mixture of 2-anilino-3-chloro-6-diethylamino-fluoran and 2-anilino-3-methyl-6-N—isoamyl-N—ethylaminofluoran in equal amounts | " | " | — |
| 6 | " | " | " | 1,1-bis(2-methyl-4-hydroxy-5-t-butylphenyl)butane |

TABLE 2

| Example No. | Print Density | Fog | Heat Fog | Print Density After Time Passage under Conditions (A) | Print Density After Time Passage under Conditions (B) |
|---|---|---|---|---|---|
| 1 | 1.20 | 0.06 | 0.10 | 1.15 | 1.10 |
| 2 | 1.15 | 0.07 | 0.12 | 1.08 | 1.06 |
| 3 | 1.16 | 0.07 | 0.13 | 1.10 | 1.08 |
| 4 | 1.19 | 0.08 | 0.10 | 1.15 | 1.12 |
| 5 | 1.14 | 0.08 | 0.12 | 1.10 | 1.05 |
| 6 | 1.12 | 0.07 | 0.10 | 1.00 | 0.95 |
| 7 | 1.13 | 0.06 | 0.10 | 1.02 | 0.99 |
| 8 | 1.22 | 0.07 | 0.11 | 1.22 | 1.19 |
| 9 | 1.17 | 0.08 | 0.13 | 1.17 | 1.14 |
| 10 | 1.17 | 0.08 | 0.13 | 1.17 | 1.13 |
| 11 | 1.22 | 0.08 | 0.12 | 1.22 | 1.15 |
| 12 | 1.20 | 0.07 | 0.13 | 1.20 | 1.17 |
| 13 | 1.13 | 0.07 | 0.12 | 1.05 | 1.00 |
| 14 | 1.12 | 0.07 | 0.13 | 1.00 | 0.95 |
| Comparative Example | | | | | |
| 1 | 1.14 | 0.07 | 0.12 | 1.03 | 0.73 |
| 2 | 1.15 | 0.10 | 0.23 | 1.10 | 1.06 |
| 3 | 1.18 | 0.08 | 0.10 | 1.05 | 0.77 |
| 4 | 1.19 | 0.11 | 0.24 | 1.17 | 1.12 |
| 5 | 1.21 | 0.08 | 0.13 | 1.11 | 0.85 |
| 6 | 1.22 | 0.12 | 0.24 | 1.21 | 1.19 |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a neutral paper support having provided on at least one surface thereof a heat-sensitive color forming layer containing a fluoran derivative having an arylamino group at the 2-position and an amine residual group at the 6-position, an electron accepting compound, a hindered phenol derivative and a heat-fusible compound represented by formula (I):

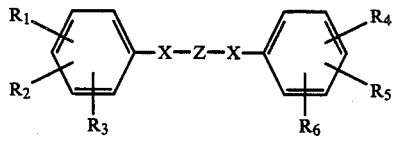

(I)

wherein $R_1$, $R_2$, $R_3$, $R_4$, $R_5$ and $R_6$, which may be the same or different, each represents a hydrogen atom, an alkyl group, an alkoxy group, a phenyl group or a halogen atom, X represents an oxygen atom or a sulfur atom, and Z represents a divalent group, wherein said neutral paper support has a pH of about 6.5 or higher after cold extraction.

2. A heat-sensitive recording material as claimed in claim 1, wherein said fluoran derivative is substituted by an anilino group having from 6 to 10 carbon atoms at said 2-position, said secondary amine residual group has 12 or less total carbon atoms at the 6-position and said 3-position is substituted by a hydrogen atom, an alkyl group having from 1 to 8 carbon atoms, an alkoxy group having from 1 to 6 carbon atoms or a halogen atom.

3. A heat-sensitive recording material as claimed in claim 2, wherein said fluoran derivative is used in combination of two or more thereof in an amount of about 10 wt % or more based on the total weight of the fluoran derivatives.

4. A heat-sensitive recording material as claimed in claim 1, wherein said divalent group is an alkylene group having from 1 to 10 carbon atoms and containing an oxygen atom, a sulfur atom, a hydroxy group or a chlorine atom.

5. A heat-sensitive recording material as claimed in claim 1, wherein said $R_1$, $R_2$, $R_3$, $R_4$, $R_5$ and $R_6$ each represents an alkyl group having from 1 to 8 carbon atoms, an alkoxy group having from 1 to 8 carbon atoms, a chlorine atom or a fluorine atom.

6. A heat-sensitive recording material as claimed in claim 1, wherein said hindered phenol derivative contains at least one alkyl substituent at the 2- or 6-position thereof.

7. A heat-sensitive recording material as claimed in claim 1, wherein said fluoran derivative is coated on said support in an amount of from about 0.2 to about 0.8 $g/m^2$.

8. A heat-sensitive recording material as claimed in claim 7, wherein said fluoran derivative is coated on said support in an amount of from 0.3 to 0.6 $g/m^2$.

9. A heat-sensitive recording material as claimed in claim 1, wherein said hindered phenol derivative contains a plurality of phenol groups.

10. A heat-sensitive recording material as claimed in claim 1, wherein said heat-fusible compound has a melting point of from 70° to 150° C.

11. A heat-sensitive recording material as claimed in claim 1, wherein X in formula (I) represents a sulfur atom.

* * * * *